US007950968B2

(12) United States Patent
Qian

(10) Patent No.: US 7,950,968 B2
(45) Date of Patent: May 31, 2011

(54) ELECTRICAL CONNECTOR HAVING DETACHABLE COVER

(75) Inventor: Zhen-Hua Qian, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/634,697

(22) Filed: Dec. 10, 2009

(65) Prior Publication Data

US 2010/0227511 A1 Sep. 9, 2010

(30) Foreign Application Priority Data

Mar. 5, 2009 (CN) ..... 200920301092

(51) Int. Cl.
*H01R 13/502* (2006.01)

(52) U.S. Cl. ..... 439/689; 439/466

(58) Field of Classification Search ..... 439/689, 439/685, 466, 468
See application file for complete search history.

(56) References Cited

U.S. PATENT DOCUMENTS

| | | | | |
|---|---|---|---|---|
| 4,109,992 | A * | 8/1978 | Hughes et al. | 439/620.21 |
| 6,666,708 | B2 * | 12/2003 | Saito | 439/466 |
| 7,147,503 | B2 * | 12/2006 | Shindo | 439/354 |
| 7,785,153 | B2 * | 8/2010 | Wang et al. | 439/668 |

FOREIGN PATENT DOCUMENTS

CN 1992435 7/2007

* cited by examiner

*Primary Examiner* — Hien Vu
(74) *Attorney, Agent, or Firm* — Andrew C. Cheng; Wei Te Chung; Ming Chieh Chang

(57) ABSTRACT

Provided is an electrical connector including an insulative housing having a main body and a supporting board extending downward from the main body so as to form an L shaped configuration. The main body defines a plurality of receiving passageways extending along a front-to-rear direction and then runs through the supporting board along a vertical direction. A pair of guiding grooves are respectively formed at opposite inner sides of the main body. A plurality of terminals are retained in the receiving passageways. A cover defines locking portions at opposite sides thereof for movably received in the guiding grooves and covers the terminals for preventing outward movement of the terminals.

7 Claims, 9 Drawing Sheets

ELECTRICAL CONNECTOR HAVING DETACHABLE COVER

BACKGROUND OF THE INVENTION

1. Field of the Invention

The present invention relates an electrical connector, and more particularly to an electrical connector having a detachable cover attached to a housing thereof facilitating readily and laborious-fee assembling.

2. Description of the Related Art

Chinese Invention Patent No. 1992435A issued to Yotsutani on Jul. 4, 2007 discloses a cable assembly comprising an insulative housing with a plurality of terminals assembled therein and a cover assembled on the insulative housing for ensuring the reliable engagement between the terminals and cables terminated to the terminals. The insulative housing defines a receiving cavity surrounded by a pair of opposite side walls for receiving the terminals and cables. Each side wall forms an aperture at an upper side for receiving a protrusion formed at each opposite side of the cover, therefore the cover could not move in a front-to-back direction. However, as there is no retention between the cover and the insulative housing in a vertical direction, the cover may get loosed from the insulative housing during the usage of the connector, risking the termination between the cables and the terminals. Obviously, an improved electrical assembly is highly desired to overcome the aforementioned problem.

SUMMARY OF THE INVENTION

Accordingly, an object of the present invention is to provide an electrical connector with an improved configuration which can provide a preferred engagement therein.

In order to achieve the object set forth, an electrical connector includes an insulative housing having a main body and a supporting board extending downward from the main body so as to form an L-shaped configuration. The main body defines a plurality of receiving passageways extending along a front-to-rear direction and then runs through the supporting board along a vertical direction. A pair of guiding grooves are respectively formed at opposite inner sides of the main body. A plurality of terminals are retained in the receiving passageways. A cover defines locking portions at opposite sides thereof for movably received in the guiding grooves and covers the terminals for preventing outward movement of the terminals.

Other objects, advantages and novel features of the invention will become more apparent from the following detailed description of the present embodiment when taken in conjunction with the accompanying drawings.

DETAILED DESCRIPTION OF THE INVENTION

Figure 1:
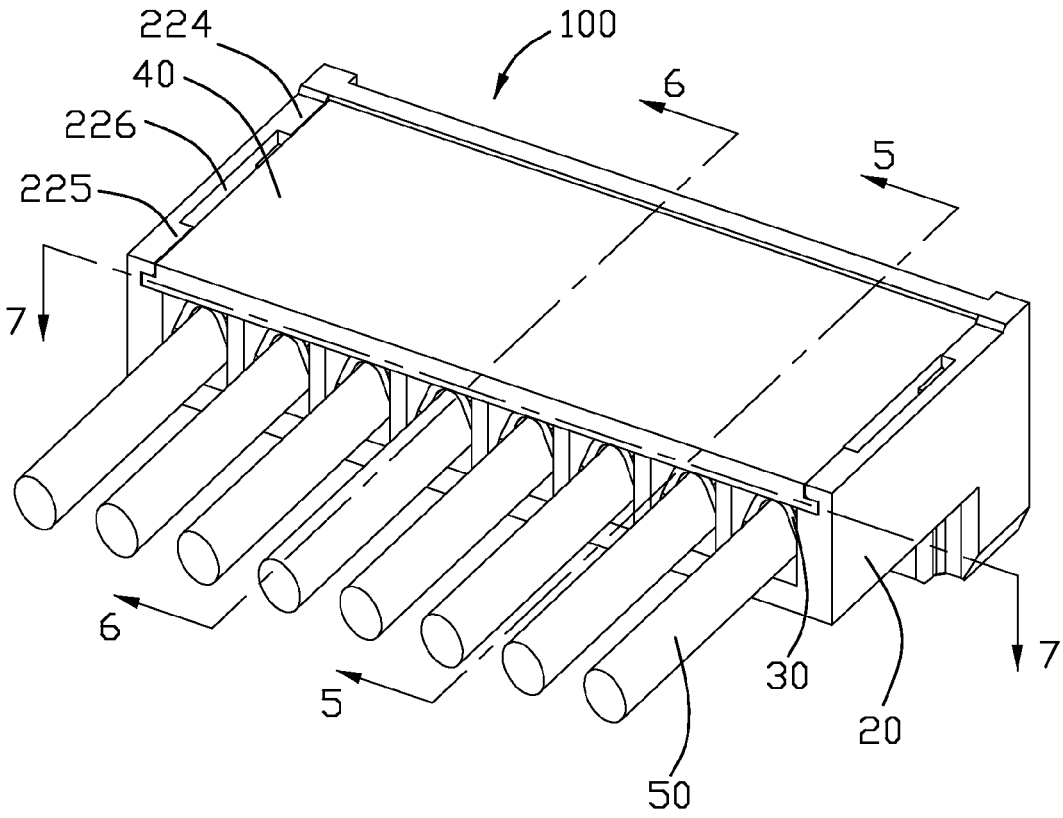
FIG. 1 is a perspective view of an electrical connector in accordance with the present invention, which shows a cover of the electrical connector in a closed position and enclosing a plurality of conductive wires therein.

Reference will now be made to the drawing figures to describe a preferred embodiment of the present invention in detail. Referring to FIG. 1, an electrical connector 100 made according to the preferred embodiment of the present invention is provided and comprises an elongated insulative housing 20, a plurality of terminals 30 received in the insulative housing, a plurality of conductive wires 50 terminated to the terminals and a cover 40 detachably on the insulative housing for enclosing the terminals 30 and conductive wires 50.

Figure 3:
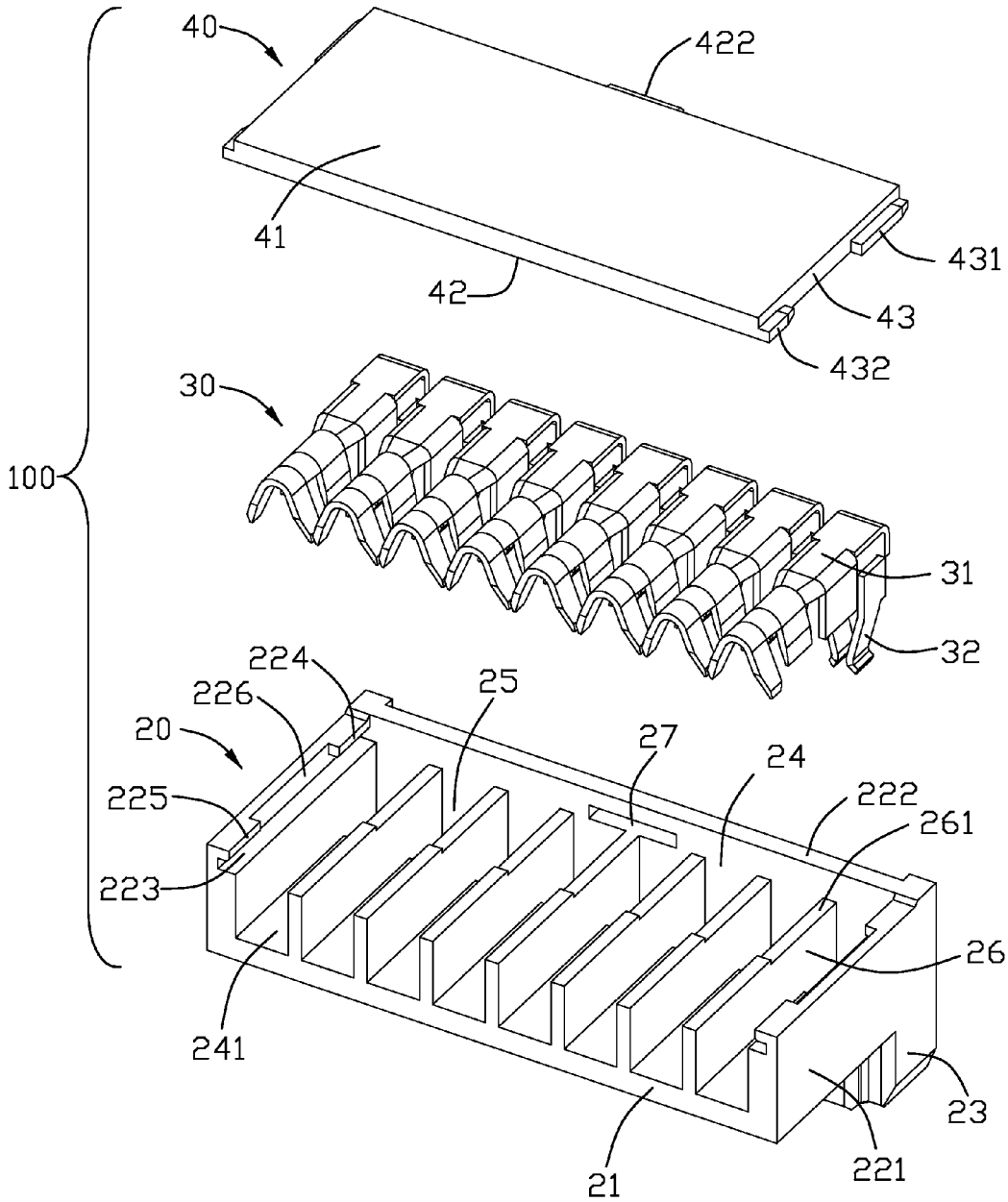
FIG. 3 is an exploded perspective view of the electrical connector shown in FIG. 1 without showing the conductive wires.
Figure 4:
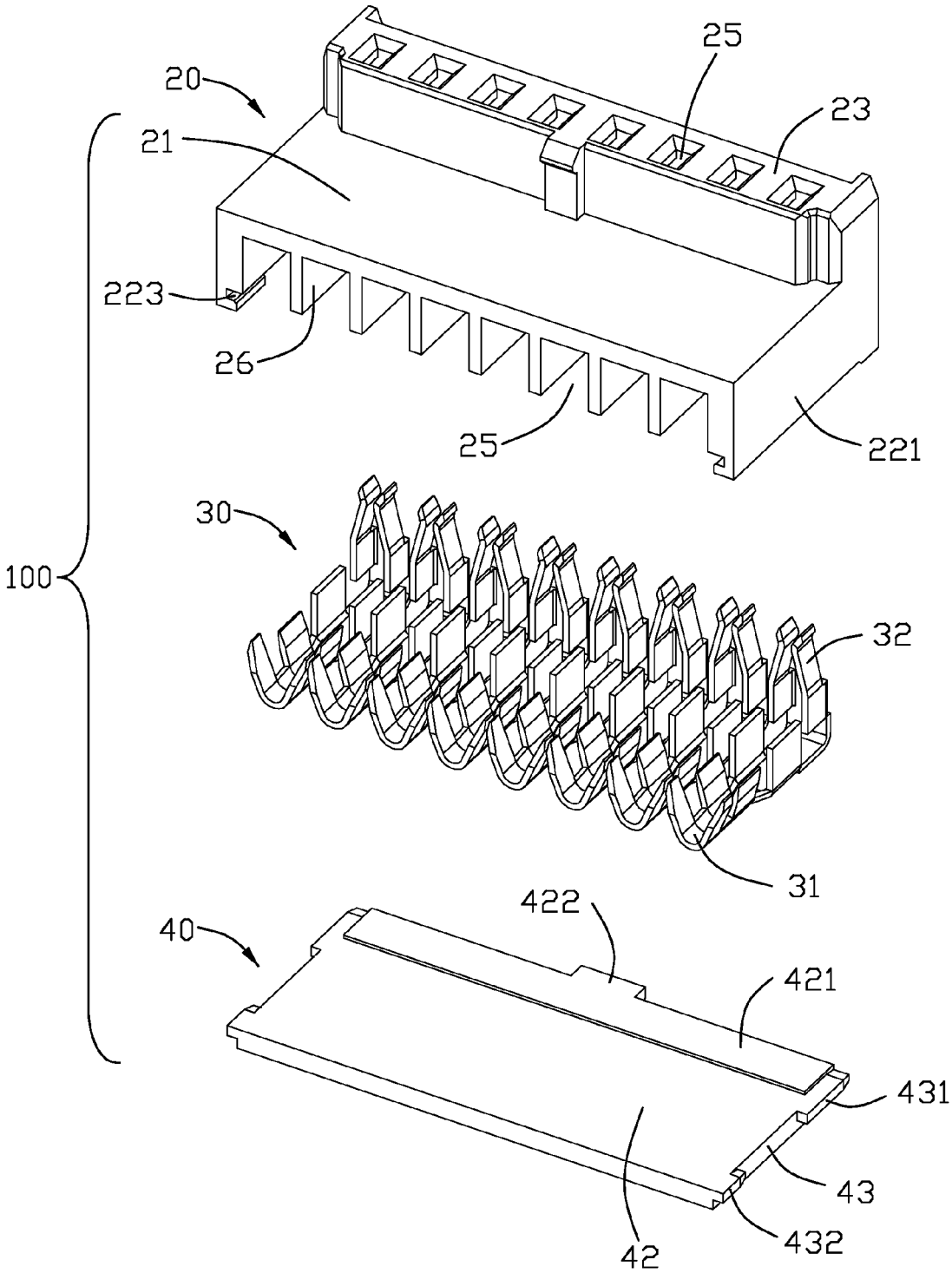
FIG. 4 is another exploded perspective view of the electrical connector shown in FIG. 1 without showing the conductive wires.

Referring to FIGS. 3 and 4, the insulative housing 20 is in an elongated configuration and comprises a rectangular bottom wall 21, vertical side walls extending upward from the bottom wall 21 and a supporting rib 23 protruding downward along a longitudinal direction of the bottom wall 21. The side walls include a pair of opposite first side walls 221 face-to-face arranged and a second side wall 222 connecting the first side walls and located at a position right above the supporting rib 23, thereby defining a receiving cavity 24 therebetween. Each first side wall 221 defines a guiding groove 223 adjacent to an upper face and extends from a front opening 241 and ends up at the second side wall 222. A first and a second blocking portions 224, 225 are formed above the guiding groove 223 and define an aperture 226 therebetween in communication with the guiding groove 223. An opening 27 is defined on the second side wall 222 in communication with the receiving cavity 24. A plurality of partitions 26 extend forward from the second side wall 222 and are spaced apart from each other in a fixed interval so as to form a receiving passageway 25 therebetween. Each receiving passageway 25 extends rearward and then downwards and runs through the supporting rib 23, that is to say, the receiving passageway 25 is configured substantially into an L-shaped arrangement for receiving and holding said terminals 30 therein. Additionally, a cut-off portion 261 is formed on each partition 26.

Each terminal 30 is configured into an L-shaped contour for inserting into the corresponding L-shaped receiving passageway 25, and comprises a base portion 31 and a clip shaped connecting portion 32 projecting downwards (not shown). The base portion 31 defines a receiving room (not figured) for receiving said conductive wires 50.

Figure 6:
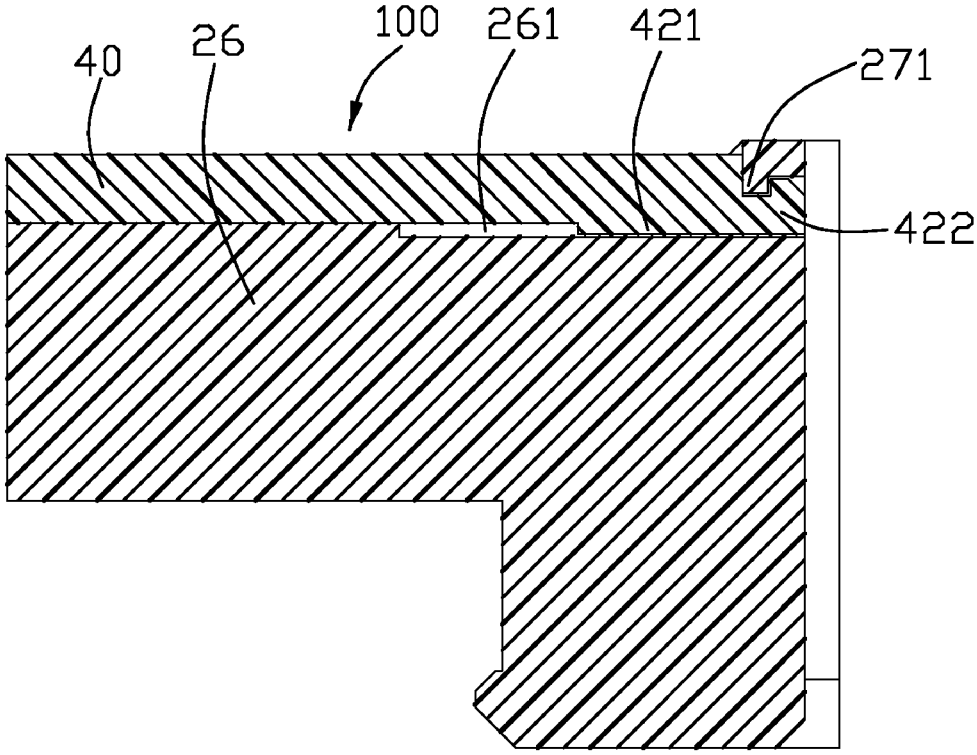
FIG. 6 is a cross sectional view of the electrical connector along line 6-6 without showing the conductive wires.

The cover 40 is configured in a rectangular shape and comprises an upper face 41, a lower face 42, two opposite sides 43 and a step portion 421 protruding downward from a rear end of the lower face 42. A first and a second wings 431, 432 are respectively formed on each side 43 and arranged in a front-to-rear direction. In addition, a hook portion 422 projects rearward from the step portion 421 for inserting into the opening 27 and holding the cover 40 on the insulative housing 20, which is best shown in FIG. 6.

Figure 2:
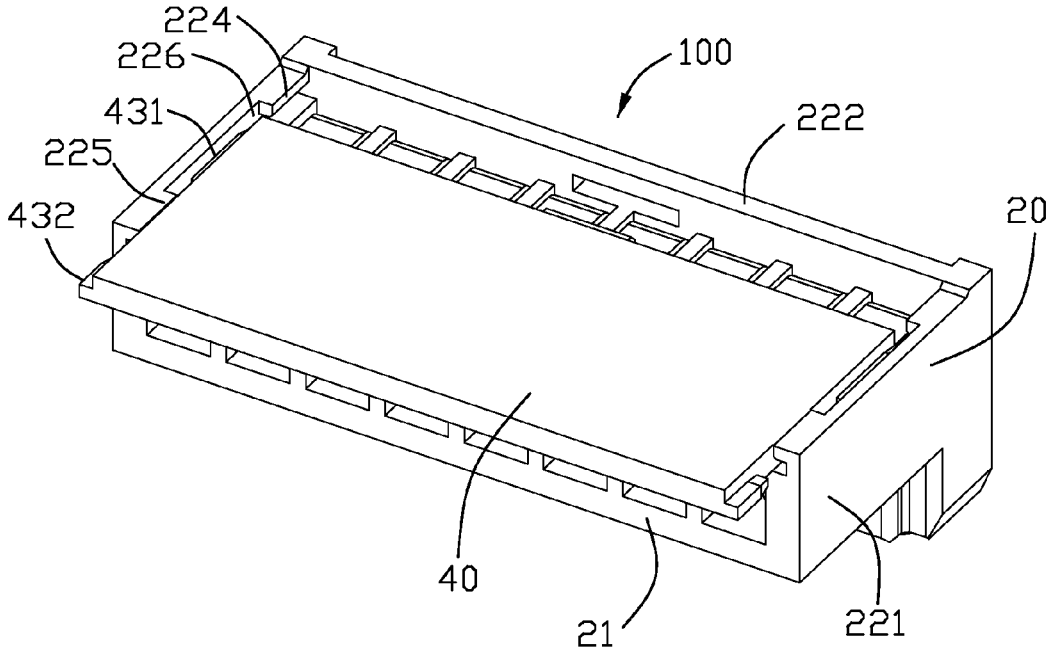
FIG. 2 is another perspective view of the electrical connector shown in FIG. 1, which shows the cover of the electrical connector in an opened position without the conductive wires therein.
Figure 5:
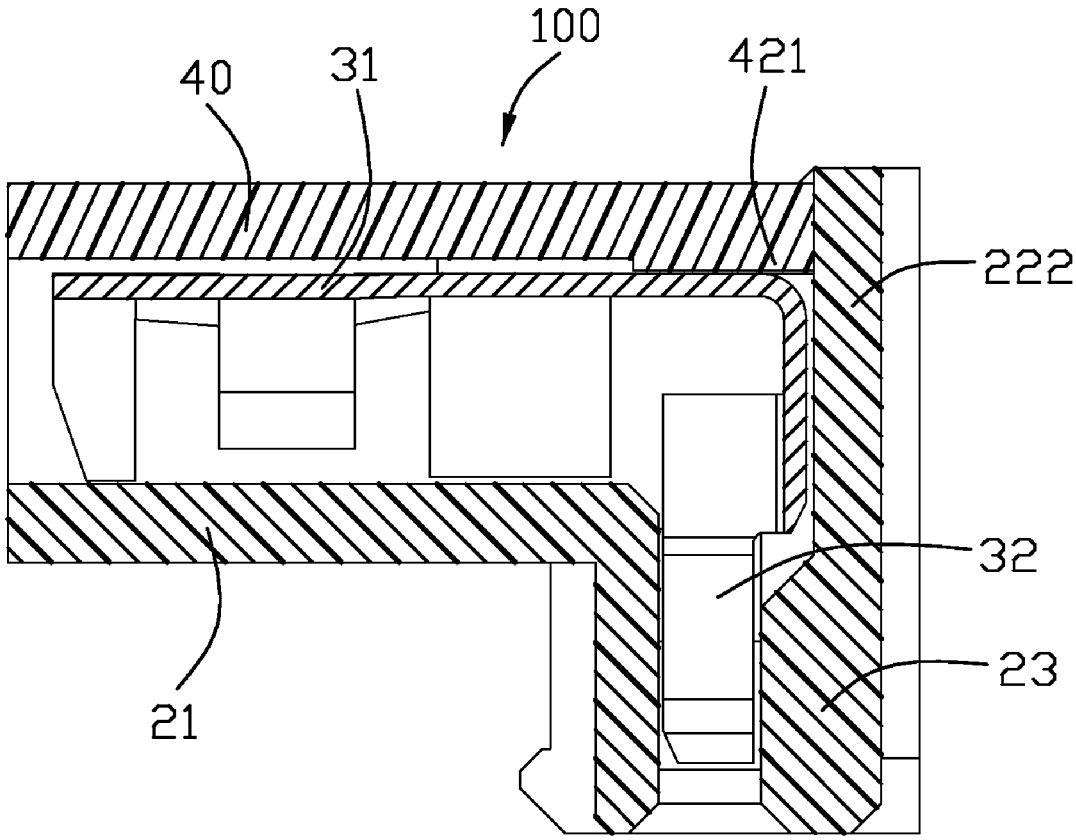
FIG. 5 is a cross sectional view of the electrical connector along line 5-5 without showing the conductive wires.
Figure 7:
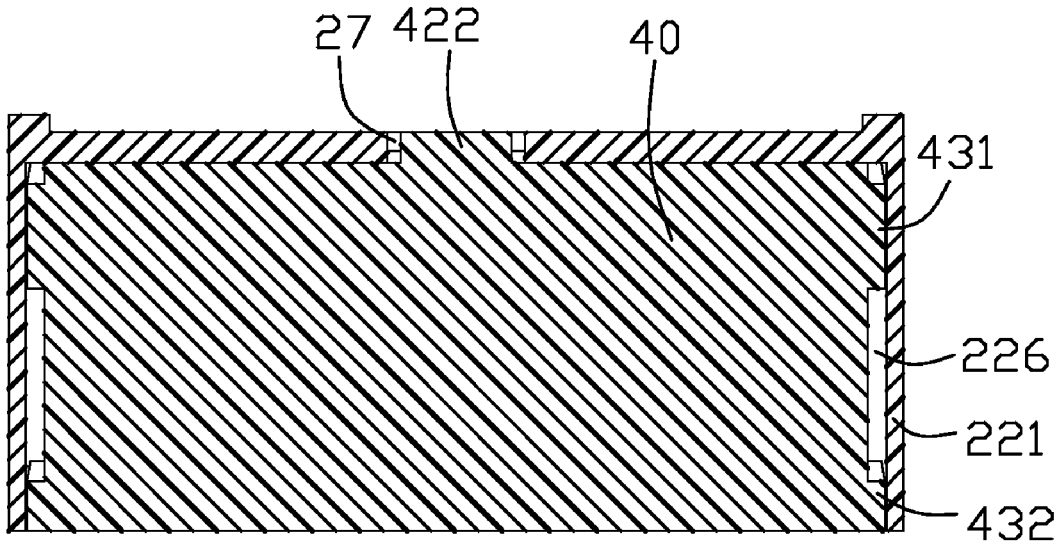
FIG. 7 is a cross sectional view of the electrical connector along line 7-7 without showing the conductive wires.

Referring to FIGS. 2 and 4, the terminals 30 are assembled into the insulative housing along a vertical direction with the connecting portion 32 projecting downwards and a base portion 31 horizontally received in the receiving passageway 25. The conductive wires 50 are terminated to the terminals 30 when the terminals 30 are retained in the insulative housing. Then the cover 40 is directly slide in the insulative housing 20 with the first wing 431 disposed in the aperture 226 and temporarily received in the guiding groove 223, while the second wing 432 exposes to an exterior of the insulative housing 20, which is best shown in FIG. 2. The above described is related to the assembling process, while the cover 40 can also be pulled out in a convert manner. Further referring to FIGS. 5-7, the cover 40 is pushed to move rearward into a final position with the first and second locking portion sliding along the guiding groove 223 until the hook portion 422 inserting into the opening 27 and buckled with the insulative housing 20. Meanwhile the step portion 421 is snugly received in the cut-off portion 261. Therefore, the electrical connector 100 is in a final status. The cover 40 could not move forward because of the hook portion 422 buckled with the opening 27. And the cover 40 has no way to move upward in the final status as the first and second locking portions 224, 225 are respectively blocked by the first and second wings 431, 432.

The present invention discloses a drawer type electrical connector with a cover 40 movably received in the insulative housing 20, therefore the cover 40 can be easily assembled on the insulative housing 20 or pulled out of the insulative housing 20 in case of any repair or rework required, and while the secured cover 40 can prevent the outward movement of the terminals 30 received therein.

Figure 8:
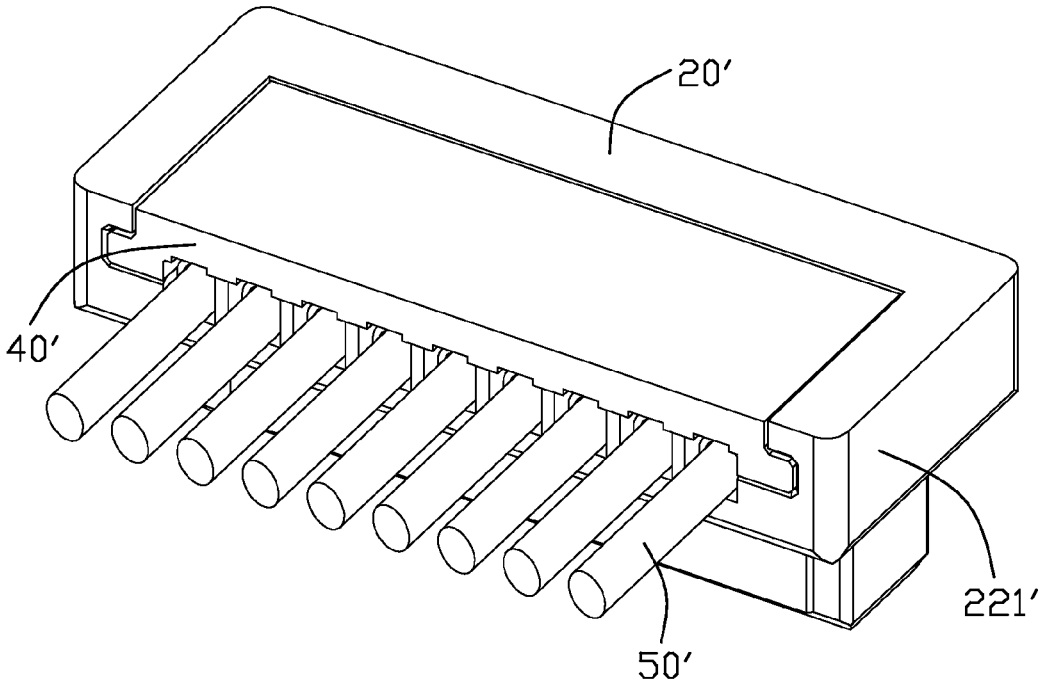
FIG. 8 is a perspective view of a second embodiment of the electrical connector in accordance with the present invention.
Figure 9:
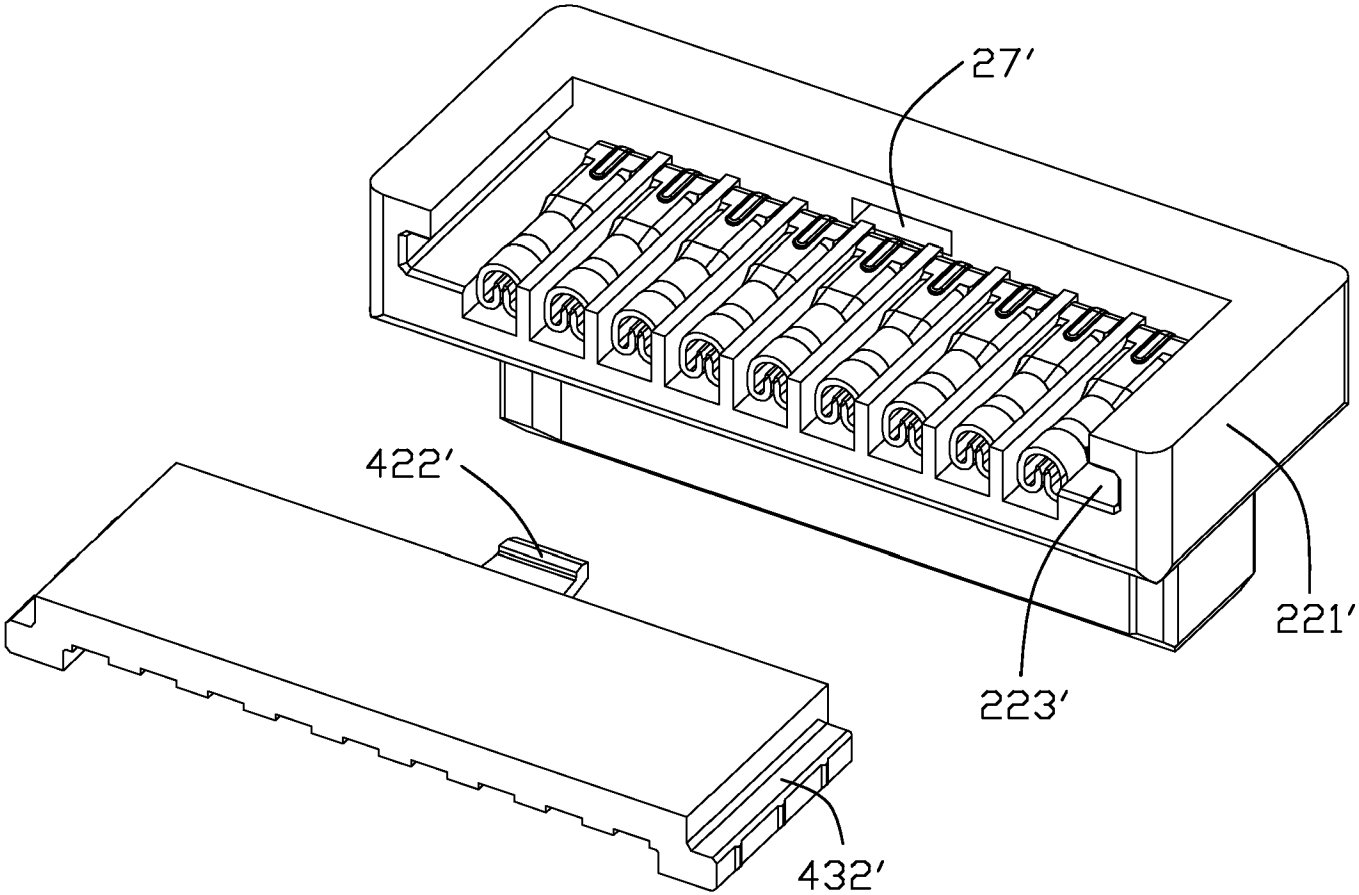
FIG. 9 is an exploded perspective view of the electrical connector shown in FIG. 8 without showing a plurality of conductive wires.

FIGS. 8 and 9 show a second embodiment of the electrical connector of the present invention, the basic structure of the electrical connector is substantially same as the electrical connector in the first embodiment. The guiding grooves 223' are respectively formed on the first side walls 221' without an aperture opened outward, and the cover 40' defines continuous wings 432' at opposite sides thereof and a hook portion 422' at longitudinal ends thereof. During the assembling, the wing 432' is inserted into the guiding grooves 223' until the hook portion 422' is buckled with the opening 27' at a rear end of the insulative housing 20'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a substantially rectangular main body and a substantially rectangular supporting rib extending downward from the main body so as to form an L-shaped configuration, the main body defining a plurality of receiving passageways extending along a front-to-rear direction and then running through the supporting rib along a vertical direction, a pair of guiding grooves being respectively formed at opposite inner sides of the main body;

a plurality of terminals retained in the receiving passageways; and a substantially rectangular cover defining locking portions at opposite sides thereof for movably received in the guiding grooves and covering the terminals for preventing outward movement of the terminals;

wherein the main body comprises a pair of first side walls face-to-face arranged and a rear second side wall connecting with the first side walls, a hook portion is defined at a longitudinal end of the cover for inserting into an opening defined on the second side wall;

wherein a plurality of partitions are formed between the first side walls and a plurality of receiving grooves are defined between every neighboring partitions for receiving said terminals;

wherein a cut-off portion is formed at each partition portion adjacent to the second side wall for receiving a step portion formed on a rear end of the cover; and wherein said rear face of the vertical section defines an opening thereon for receiving a hook formed on a top longitudinal side edge of the cover.

2. An electrical connector comprising:

an insulative housing defining a L-shaped configuration in a side view and including a substantially rectangular horizontal section which has opposite top and bottom walls with a plurality of horizontal passageways extending therethrough in a front-to-back direction, and a substantially rectangular vertical section including a front vertical wall below said horizontal section, a plurality of vertical passageways extending vertically and communicating and aligned with the corresponding horizontal passageways, respectively, each of said vertical passageways cooperating with the corresponding horizontal passageway to commonly form an L-shaped passage;

a plurality of contacts associated with corresponding wires and forwardly assembled into the corresponding L-shaped passage, respectively;

each of said contacts including:

a horizontal contact section received in the horizontal passageway of the corresponding passage; a contact retention section for retaining the contact in the housing, a wire conductor retention section for retaining an inner conductor of the wire to the contact, and a wire jacket retention section for retaining an outer jacket of the wire to the contact, all received in the vertical passageway of the corresponding passage; and a cover attached on a rear face of the vertical section of the housing and covering rear sides of said vertical passageways and the associated contacts and wires therein;

wherein said rear face of the vertical section defines an opening thereon for receiving a hook formed on a longitudinal side of the cover, wherein the vertical wall defines a pair of guiding grooves to guidably receive two opposite side edge of the cover, wherein the cover further defines a hook portion retained in a corresponding opening in the housing when said cover fully covers the rear face of the vertical section of the housing, wherein said hook portion is located at a top edge of the cover.

3. The electrical connector as claimed in claim 2, wherein said cover is attached to the housing in an upward vertical direction.

4. The electrical connector as claimed in claim 3, wherein each of said contacts defines an L-shaped area around a joint of said contact section and the contact retention section under condition that said L-shaped area intimately confronts a top wall of the horizontal section and the cover, respectively.

5. The electrical connector as claimed in claim 4, wherein said contact retention section, said conductor retention section and said jacket retention section essentially all face forward.

6. The electrical connector as claimed in claim 5, wherein the vertical section defines a pair of vertical guiding grooves to receive two side edges of the cover.

7. The electrical connector as claimed in claim 6, wherein a top of said cover defines a latch locked into a locking recess formed in a rear portion of the top wall of the housing.

* * * * *